US006570075B1

(12) United States Patent
Lombardi

(10) Patent No.: US 6,570,075 B1
(45) Date of Patent: May 27, 2003

(54) CONTROLLED TILTING OF CYMBALS DEVICE

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 10/067,925

(22) Filed: Feb. 7, 2002

(51) Int. Cl.[7] ..... G10D 13/02
(52) U.S. Cl. ..... 84/421
(58) Field of Search ..... 84/421, 422.3, 84/327, 422.2

(56) References Cited

U.S. PATENT DOCUMENTS 4,122,750 A * 10/1978 Rinker ..... 84/421
5,052,262 A * 10/1991 Havens ..... 84/421
5,063,819 A 11/1991 Hoshino
6,054,645 A * 4/2000 Gauger ..... 84/422.3

* cited by examiner

*Primary Examiner*—Shih-Yung Hsieh
(74) *Attorney, Agent, or Firm*—William W. Haefliger

(57) ABSTRACT

A cymbals disc tilt mechanism, comprising an upright member, and a head at the top of the member, a disc tilter on the head, a bell crank pivotally carried by the head, the crank having a first arm to tiltably elevate and lower the tilter as the crank is pivoted, the crank also having a second arm projecting downwardly, a carrier projecting sidewardly, and an adjuster on the carrier and movable to deflect the second arm, to pivot the bell crank.

11 Claims, 1 Drawing Sheet

CONTROLLED TILTING OF CYMBALS DEVICE

BACKGROUND OF THE INVENTION

This invention relates generally to controlled tilting of a cymbals disc, as on a high hat stand; and more particularly concerns an improved tilting apparatus easily adjustable by a drummer.

There is need for devices that enable the drummer to easily and quickly adjust the tilt angle of a cymbals disc, to accommodate to his height or position relative to the cymbals, enabling playing of the cymbals to best advantage. I am not aware of any prior or existing device which embodies all the advantages in structure, function and result provided by the device of this invention.

SUMMARY OF THE INVENTION

It is a major object of the invention to provide an improved cymbal's disc tilting device as referred to. Basically, the device or mechanism comprises:.

a) an upright member, and a head at the top of member, b) a disc tilter on the head, c) a bell crank pivotally carried by the head, the crank having a first arm to tiltably elevate and lower the tilter as the crank is pivoted, the crank also having a second arm projecting downwardly, d) a carrier projecting sidewardly, and an adjuster on the carrier and movable to deflect the second arm, to pivot the bell crank.

As will appear, the carrier in a preferred device comprises a threaded shank having fixed, non-adjustable, lateral position, and the adjuster comprises a nut, such as a wing nut, in threaded engagement with the shank, to controllably deflect the bell crank second arm, thereby causing the bell crank to pivot and lift or lower the cymbals disc tilter.

It is another object to provide the crank second arm to extend over the shank, so that the adjusting nut is movable, by rotation, generally horizontally, for easy access and manipulation by the drummer.

An added object is to provide a pivot connecting the crank to the head to enable pivoting of first arm upwardly and downwardly. In this regard, the pivot may have a generally horizontal axis to enable pivoting displacement of the second arm, generally horizontally.

Yet another object is to provide a spring urging the second arm toward the adjusting nut. This enables adjustment by the drummer of only one element, i.e. the wing nut, to either raise or lower the tilter, and without need to tighten any additional lock nut.

These and other objects and advantages of the invention, as well as the details of an illustrative embodiment, will be more fully understood from the following specification and drawings, in which:

DRAWING DESCRIPTION

Figure 1:
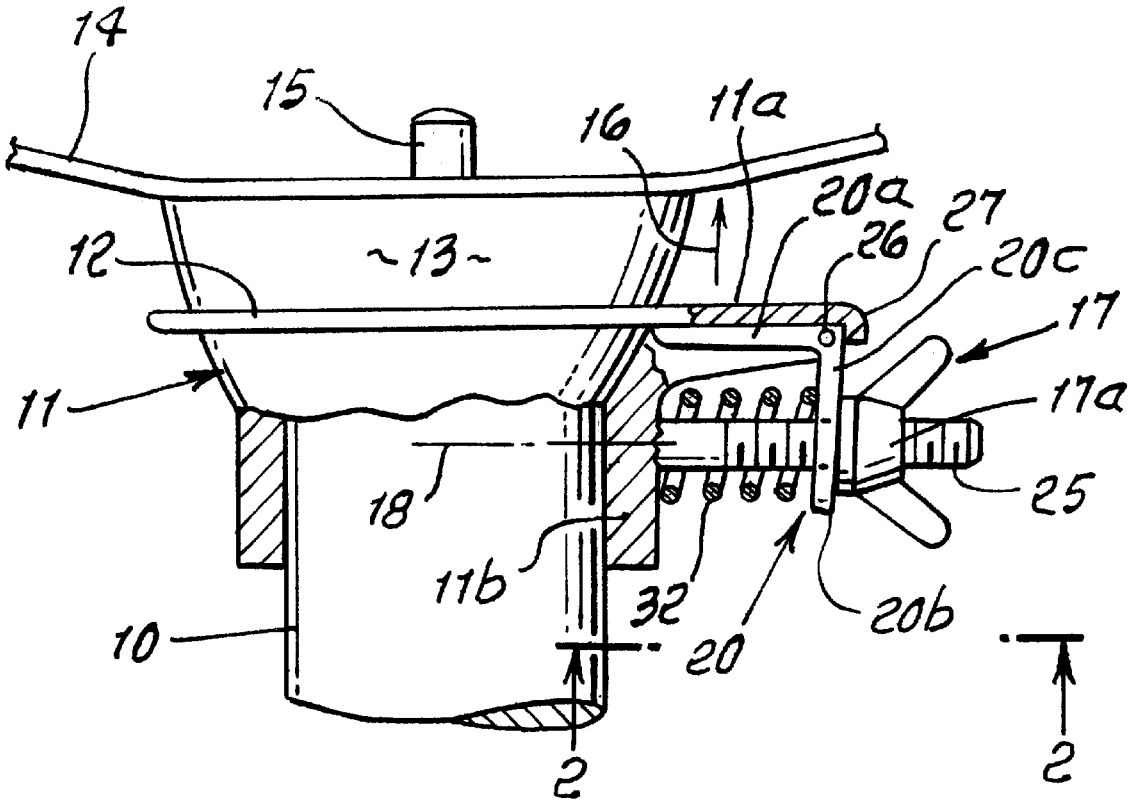
Figure 2:
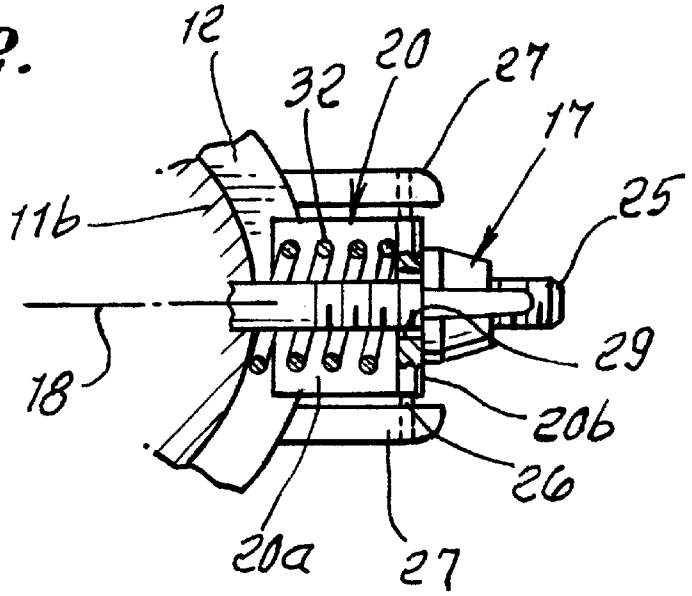

FIG. 1 is an elevation, partly in section, showing preferred cymbals tilt mechanism embodying the invention; and FIG. 2 an enlarged bottom plan view, taken in section on lines 2—2 of FIG. 1.

DETAILED DESCRIPTION

In the drawings, an upright member, such as a metallic stand or tube 10 mounts or supports en enlarged head member 11. The latter in turn may typically freely supports an annular tilter 12 that in turn supports a tiltable cushion 13. A cymbals disc 14 is carried on the cushion, and positioned by a central post 15 on the head. When tilter 12 is tilted upwardly, as indicated by arrow 16, the cymbals disc 14 is also tilted, as for example counter clockwise in FIG. 1. It is desired that the tilter 12 be controllably and accurately tilted, and in an easy and convenient manner, to controllably tilt the cymbals disc 14, as via the cushion 13. The disc 14 may extend under 13 in supporting relation.

In accordance with the invention, a rotary adjuster 17, as for example a wing nut, is manually rotatable about a generally horizontal axis 18, and at one side of the head member 11, to effect such controllable tilting. As the adjuster is rotated in one direction, as for example clockwise about axis 18, one side portion of the cymbals is tilted upwardly, as indicated by arrow 16; and if the adjuster is rotated in the opposite direction, as for example counterclockwise about axis 18, the cymbals tilt is reduced.

Motion transfer from 17 to 12 is simply, efficiently and controllably obtained by provision of a bell crank 20 and a carrier 25. The crank is pivotably carried as by a sideward extension 11*a* of the head member 11, the crank having a first and leftwardly extending arm 20*a* positioned beneath an edge of tilter disc 12 to tiltably elevate and lower 12 as the crank is pivoted; the crank also has a second arm 20*b* projecting generally downwardly. An L-shaped mid-portion 20*c* of the crank 20 has pivotal connection, as by horizontal pivot pin 26, with two extension lugs 27 integral with the head. The crank pivots between such lugs.

The carrier 25 has integral connection with the head member sleeve 11*b*, that fits about tube 10. The carrier is typically threaded to threadably carry the wing nut 17; and the carrier is elongated generally horizontally to extend through an enlarged opening 29 in the crank lower arm 20*b*, whereby the wing nut may be easily manually adjusted, i.e. rotated about the carrier axis 18. The base 17*a* of the wing nut bears against the crank lower arm 20*b* adjacent opening 29, to advance 20*b* to the left, as the nut is rotated in one direction.

A spring, such as coil spring 32 extends about the carrier 25, and is compressed between the crank lower arm 20*b* and the outer side of the head sleeve 11*b*. Therefore, the spring automatically urges the crank lower arm 20*b* to the right, as the wing nut is counter-rotated, as for example leftwardly, thereby lowering the tilt adjuster under control of the rotary adjustment of the wing nut. Accordingly, the drummer may easily and with one hand only, rotate the sidewardly presented wing nut to effect increasing or decreasing tilting of the cymbals, which is then held in selected tilt adjusted position.

I claim:

1. A cymbals disc tilt mechanism, comprising a) an upright member, and a head at the top of said member, b) a disc tilter on the head, c) a bell crank pivotally carried by the head, the crank having a first arm to tiltably elevate and lower the tilter as the crank is pivoted, the crank also having a second arm projecting downwardly, d) a carrier projecting sidewardly, and an adjuster on the carrier and movable to deflect said second arm, to pivot the bell crank.

2. The combination of claim 1 wherein the carrier is a threaded shank, and the adjuster is a nut in threaded engagement with said shank.

3. The combination of claim 2 wherein the second arm extends our the shank, so that the adjusting nut is movable generally horizontally in alignment with said second arm.

4. The combination of claim 1 including a pivot connecting the crank to the head to enable pivoting of the first arm upwardly and downwardly.

5. The combination of claim 4 wherein the pivot has a generally horizontally axis to enable pivoting displacement of the second arm generally horizontally.

6. The combination of claim 2 including a spring urging the second arm toward the adjusting nut.

7. The combination of claim 6 wherein the spring is a coil spring extending about the threaded shank.

8. The combination of claim 1 including said cymbals disc carried on the head, to tilt relative to the head.

9. The combination of claim 8 including a cushion between the tilter and the cushion.

10. The method of operating a cymbals disc tilt mechanism, comprising a) an upright member, and a head at the top of said member, b) a disc tilter on the head, c) a bell crank pivotally carried by the head, the crank having a first arm to tiltably elevate and lower the tilter as the crank is pivoted, the crank also having a second arm projecting downwardly, d) a carrier projecting sidewardly, and an adjuster on the carrier and movable to deflect said second arm, to pivot the bell crank, said method including:

e) controllably displacing the adjuster relative to the carrier, to generally horizontally displace said second arm, f) and in response to pivoting of the crank, causing said first arm to elevate or lower a portion of the tilter at one side of the head.

11. The method of claim 10 including pivotally supporting the crank at one side of the head.

* * * * *